US005807289A

United States Patent [19]

Camp

[11] Patent Number: 5,807,289

[45] **Date of Patent: *Sep. 15, 1998**

[54] WATER JET APPLIANCE

[76] Inventor: Gregory T. Camp, 205 E. 69th St., Apt. 5A, New York, N.Y. 10021

[ * ] Notice: The term of this patent shall not extend beyond the expiration date of Pat. No. 5,542,909.

[21] Appl. No.: 692,330

[22] Filed: Aug. 5, 1996

Related U.S. Application Data

[63] Continuation-in-part of Ser. No. 219,046, Mar. 28, 1994, Pat. No. 5,542,909, which is a continuation-in-part of Ser. No. 898,110, Jun. 12, 1992, abandoned.

[51] Int. Cl.[6] ..... A61H 9/00

[52] U.S. Cl. ..... 601/160; 4/541.3; 601/154

[58] Field of Search ..... 601/160, 154, 601/167; 4/541.3

[56] References Cited

U.S. PATENT DOCUMENTS

| | | | |
|---|---|---|---|
| 3,801,019 | 4/1974 | Trenary et al. | 239/383 |
| 4,282,866 | 8/1981 | Miffitt | 601/167 |
| 5,542,909 | 8/1996 | Camp | 601/160 |

*Primary Examiner*—William H. Grieb
*Attorney, Agent, or Firm*—Milde, Hoffberg & Macklin, LLP

[57] ABSTRACT

A hand-held, self-contained, self-powered, submersible, portable water pump appliance having physical dimensions and weight enabling it to be hand-held and transportable by a person. The appliance can recirculate water in a pool of water, as in a bathtub or spa, and is useful for providing massage and stimulation to the body of a person.

55 Claims, 7 Drawing Sheets

FIG.8A
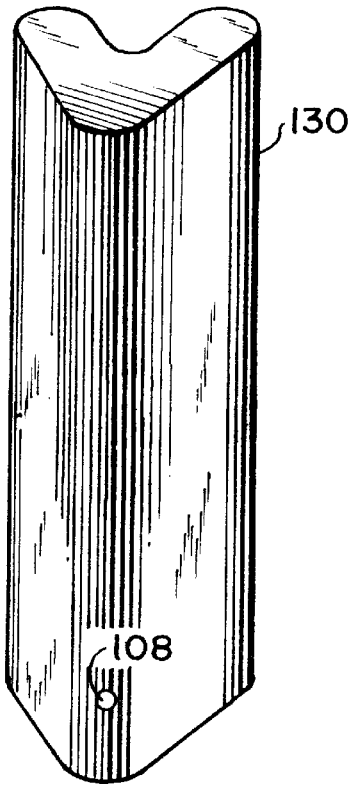
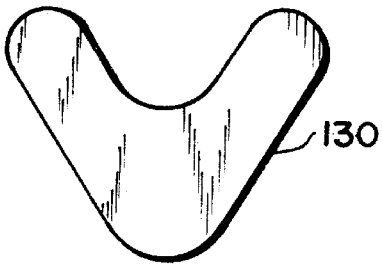
FIG.8B
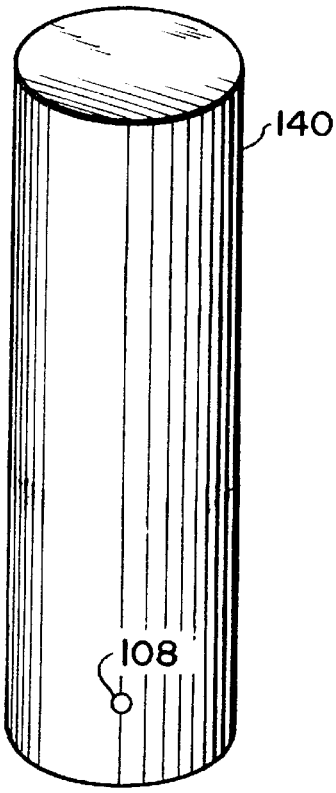
FIG.9A
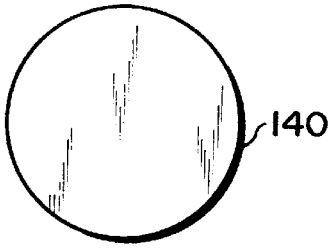
FIG.9B
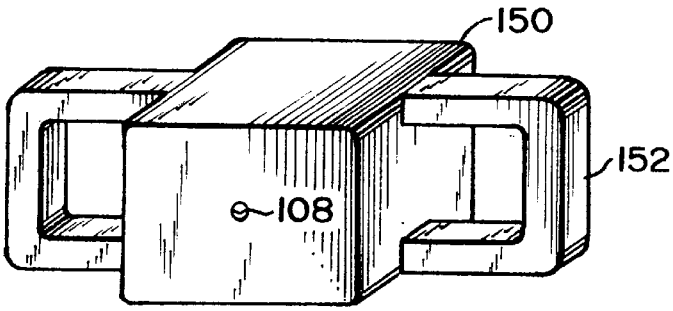
FIG.10

FIG.17A
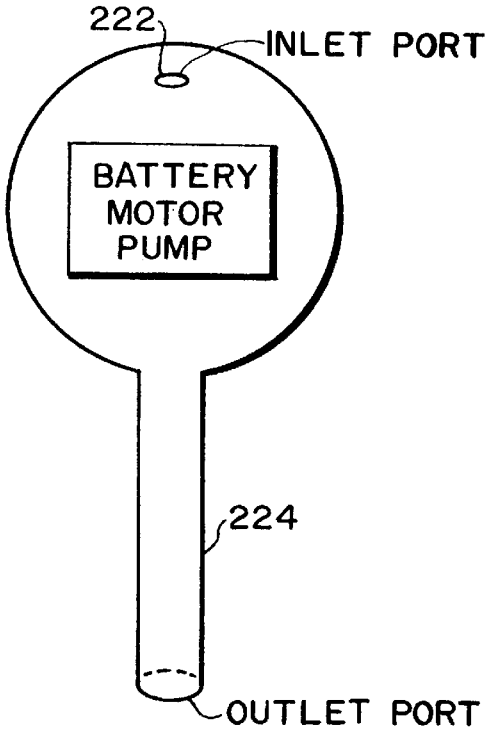
FIG.17B
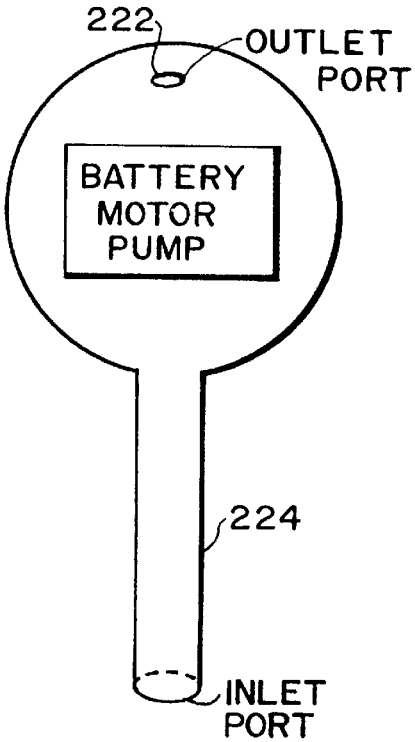
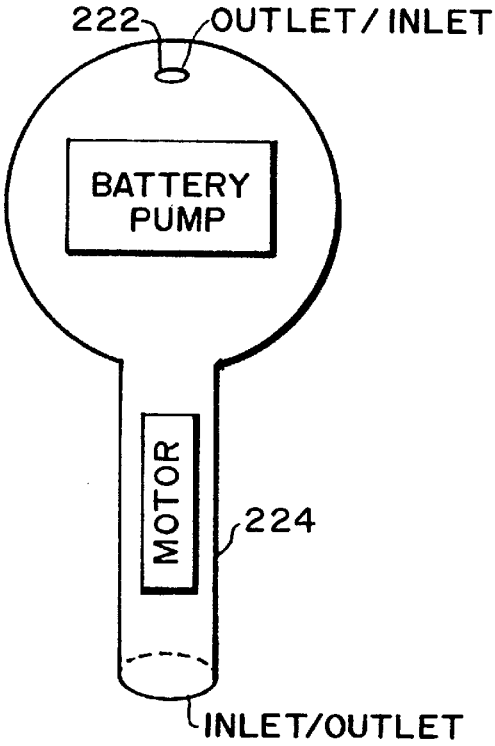
FIG.17C
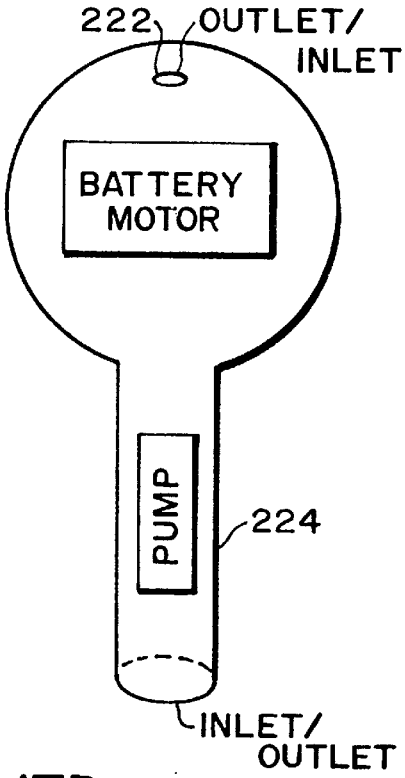
FIG.17D

WATER JET APPLIANCE

CROSS-REFERENCE TO RELATED APPLICATION

This application is a continuation-in-part of U.S. patent application Ser. No. 08/219,046, filed Mar. 28, 1994, entitled "WATER JET APPLIANCE", now U.S. Pat. No. 5,542,909, which is a continuation-in-part of U.S. patent application Ser. No. 07/898,110, filed Jun. 12, 1992, entitled "WATER JET APPLIANCE", now abandoned.

BACKGROUND OF THE INVENTION

The present invention relates to a hand-held portable, self-contained, self-powered, water-submersible water jet appliance useful for providing hydro-massage, enhanced relaxation and other therapeutic benefits.

The use of water sprays and jets for human cleanliness, relaxation and therapy is well known. There are numerous appliances known in the art for providing such sprays and jets. Such appliances can be as simple as an ordinary shower head. Various designs are also known for spas and therapy pools, some of which are now available in sizes that can be used in the home. Generally, however, shower heads, spas and therapy pools provide water sprays and jets from nozzles which, while adjustable over a limited range, are fixed in place. This leads to two distinct disadvantages.

One disadvantage is that, since such appliances are permanently fixed in place and permanently connected to a domestic plumbing system, they cannot conveniently be taken from place to place.

A second disadvantage is that, being fixed in place, such appliances cannot be conveniently used to direct their water jet towards all parts of the body. A person enjoying a spa, for example, can, in a very limited way, adjust his or her body position so that the water jet or spray massages certain preferred areas of the body; however, because the appliance is fixed in place, it is not accessible to all areas of the person's body.

A partial solution of this problem has been provided by a variety of hand-held shower heads. These, however, still suffer from many of the aforesaid limitations. They must be connected to a water source, such as a common water faucet, and must rely on the domestic water system for the amount of water pressure available. They cannot generate their own water pressure. In addition, the water they use is added to the pool already in the bathtub, thereby filling the tub beyond the desired level. This is an inconvenience and a waste of water.

While they can be disconnected and transported, such disconnection and reconnection is not always easily accomplished. A traveler cannot count on the "fittings" at the places he visits being matched to those on his hand-held shower head.

In addition, hand-held shower heads are suitable for projecting a water stream through the air, to impinge or fall upon the human body. They are not, however, generally convenient for use under water. For example, a person sitting in a bathtub full of water could find it inconvenient to use an ordinary hand-held shower head to massage those parts of his or her body that are submerged beneath the water level. Such shower heads are generally cumbersome to move, and lack the flexibility needed to conveniently apply them to all parts of the body.

Still another partial solution to the problem of providing massage and stimulation to a person's body are devices, such as those disclosed in the U.S. Pat. No. 5,195,511 to Kodato et al., which provide a "bubble massage". Such devices aspirate air to produce a stream of water containing tiny bubbles. For this purpose, the air enters the unit through an air line or hose which extends outward to a chamber or the like that is placed in the open air, e.g., outside the bathtub.

The U.S. Pat. No. 4,282,866 to Miffitt discloses still another appliance for providing a hydro-massage in a bathtub. This "shoebox shape" appliance is provided with a vacuum grip for attaching itself to the wall of the tub. Although the device includes a handle for carrying, it is not truly "portable" in the sense that it is intended to be held in the hand while in use.

The German DOS No. 4,004,801 discloses a hydro-massage appliance for use in the bathtub which, like the device of Miffitt, is relatively large and is designed to be attached to the wall of the tub by a suction cup.

SUMMARY OF THE INVENTION

Accordingly, the principal object of the present invention is to provide a hand-held, self-contained, self-powered, water-submersible, portable water jet appliance that avoids or eliminates the problems and limitations mentioned above.

More particularly, it is an object of the present invention to provide a hand-held self-contained, self-powered, submersible, portable water jet appliance which provides a stream of water that is suitable for both above and completely under-water use in human massage.

These objects, as well as other objects which will become apparent to those skilled in the art, are achieved, in accordance with the present invention, by providing a water jet appliance comprising, in combination, (a) an electric motor, electrically connected to and powered by a battery; (b) a water pump mechanically connected to and powered by the electric motor and having both an inlet port and an outlet port; and (c) a completely submersible housing containing and completely sealing the battery, motor and pump. The housing has openings for the inlet port and outlet port of the pump and, with its contents, has an external physical size and shape, as well as weight, that enable the appliance to be conveniently hand-held when in use and manipulated and transported by a person.

The battery, motor and pump are of such capacity as to eject a water stream from the outlet port which is sufficient for substantial body massage.

In use, the entire apparatus may be completely submerged in water and held in the hand to direct a water stream on any desired part of the body.

Preferably, the battery is rechargeable when the apparatus is not in use.

Furthermore, means may be provided to pulsate the water stream ejected from the apparatus, to adjust the water pressure and flow at the outlet port, to adjust the spread of water emerging from the outlet port and/or to provide and adjust for aeration of the water stream. Such means may be arranged in a suitable nozzle at the outlet port or otherwise.

There are many nozzles that can be used in the practice of this invention. Although it is preferred to join the nozzle directly to the outlet of the pump, it is also within the scope of the present invention to join the nozzle to the outlet through a hose. In the preferred embodiment, the nozzle is joined directly to the outlet of the pump, whereby the entire appliance is moved about the body to apply water massage to desired parts of the body. When the hose is used, the person using the appliance would place the appliance in the water, and then manipulate the nozzle around the various parts of the person's body where the action of the water jet was desired.

The appliance can be provided with a device for pulsating the water or an air/water mixture passed therethrough. The nozzle is preferably adjustable with respect to degree of pulsation, including a range of from no pulsation to full pulsation, and is also adjustable with respect to stream configuration so that the stream can be narrow or widely dispersed such as, for example, a spray. There are a variety of commercially available pulsating shower heads known in the art, and it is within the scope of the present invention to adapt such pulsating devices for use in the water-jet nozzle of the present invention.

The nozzle may be mounted to the outlet through an adjustable mount, such as that used for a common shower head, so that the direction of the water stream from the nozzle can be varied.

Finally, the appliance can be provided with an inlet port for air and a tube leading from the inlet port to the water pump, thereby permitting aeration of the water stream.

For a full understanding of the present invention, reference should now be made to the following detailed description of the preferred embodiments of the invention as illustrate d in the accompanying drawings.

BRIEF DESCRIPTION OF THE DRAWINGS

FIG. 8A is a perspective view of one side of a portable water jet appliance according to a second preferred embodiment of the invention.

FIG. 8B is a top view of the water jet appliance of FIG. 8A.

FIG. 9A is a perspective view of one side of a portable water jet appliance according to a third preferred embodiment of the invention.

FIG. 9B is a top view of the water jet appliance of FIG. 9A.

FIG. 10 is a perspective view of one side of a portable water jet appliance according to a fourth preferred embodiment of the invention.

FIG. 17, which comprises FIGS. 17A, 17B, 17C and 17D illustrate a water jet appliance having a spherical head and tubular handle.

DESCRIPTION OF THE PREFERRED EMBODIMENTS

Figure 1:
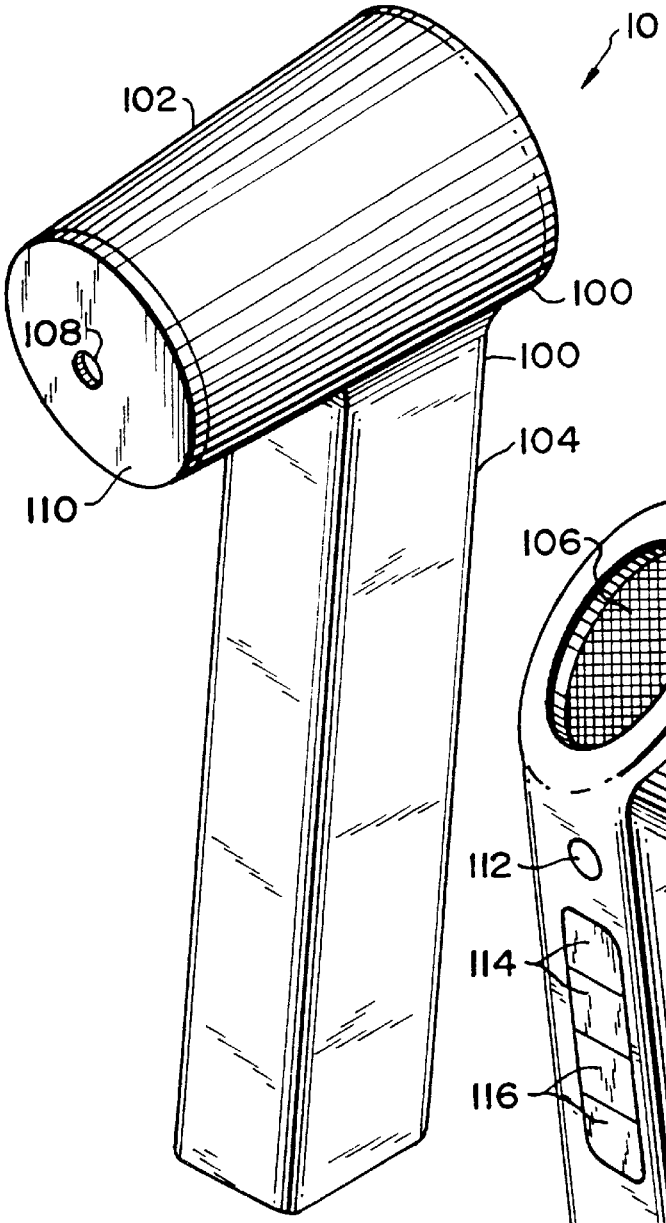
FIG. 1 is a perspective view of one side of a portable water jet appliance according to the principal preferred embodiment of the invention.

The preferred embodiments of the present invention will now be described with reference to FIGS. 1–16 of the drawings. Identical elements in the various figures are designated with the same reference numerals.

Figure 2:
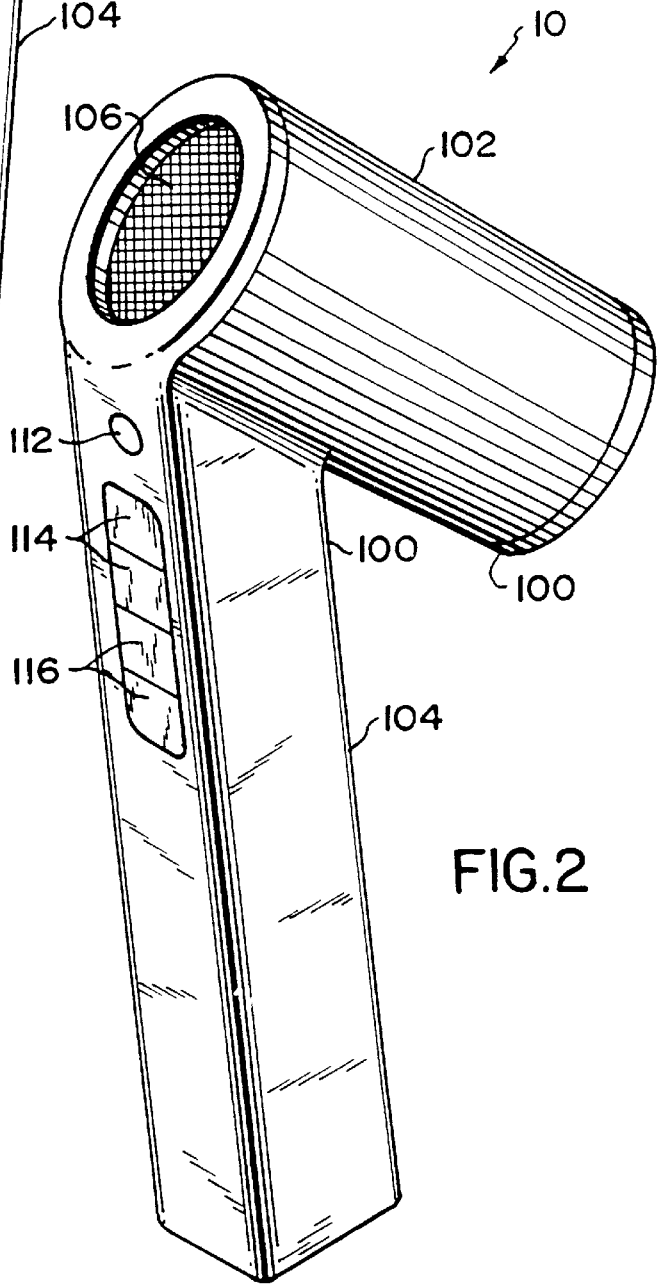
FIG. 2 is a perspective view of the opposite side of the water jet appliance of FIG. 1.

FIGS. 1 and 2 illustrate a hand-held, self-contained, self-powered, submersible, portable water jet appliance according to the principal preferred embodiment of the present invention. This appliance 10 comprises a housing 100 having a head portion 102 and a handle portion 104. The handle 104 contains an electric battery as well as suitable controls and electronics. The head portion 102 contains an electric motor, electrically connected to and powered by the battery, and a water pump, mechanically connected to and powered by the motor. The housing has a water inlet 106 and a water outlet 108. Associated with the outlet 108 is a dial 110 for adjusting the width of the flow opening.

Arranged on the back of the handle are a battery indicator light 112, flow and pressure adjustment (including on/off) switches 114 and switches 116 to control the presence and speed of pulsation.

Figure 3:
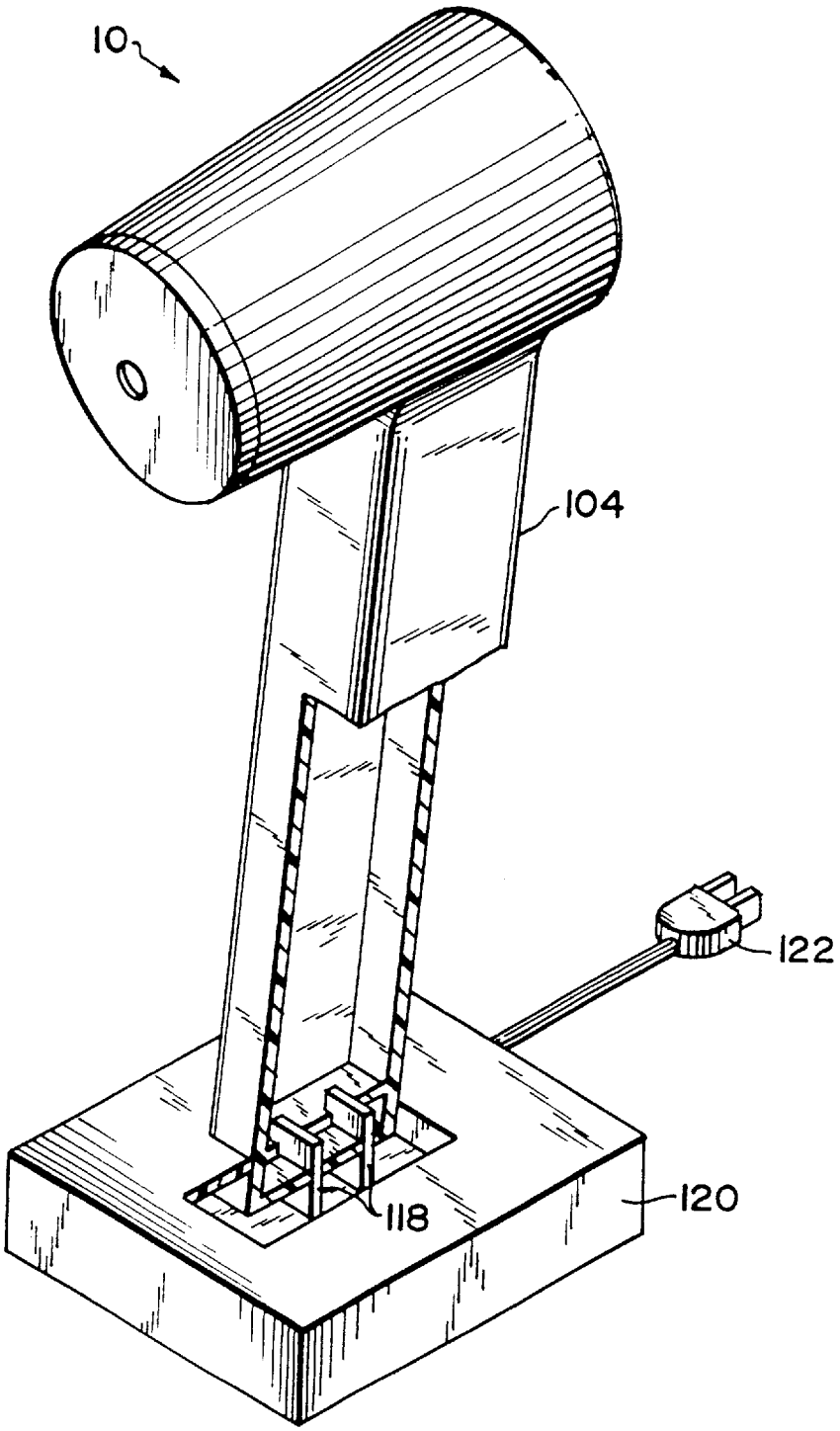
FIG. 3 is a perspective and partially cut-away view of the water jet appliance of FIG. 1 placed on a recharger unit.

As shown in FIG. 3, the base of the handle portion 104 which forms the battery compartment, includes a plug 118 that plugs into a recharger unit 120. This recharger unit comprises a transformer, rectifier and other necessary electronics for converting 110 volt AC received from a standard wall plug 122 into 12 or 24 volt DC current suitable for charging the battery.

If desired, inlet and outlet "nipples" may be placed at the water inlet 106 and/or water outlet 108 to permit the attachment of a flexible hose.

In any case, the housing 100 of the water jet appliance 10 is completely submersible and, with its contents, has an external physical size and shape, as well as weight, that enable the appliance to be conveniently hand-held when in use and manipulated and transported by a person.

Therefore, when in use, the entire apparatus is preferably completely submerged in water and held in the hand to direct a water stream on any desired part of the body. The battery, motor and pump receive water through the water inlet port 106 and eject water through the outlet port 108 with such quantity and flow rate as to be sufficient for substantial body massage.

Figure 4:
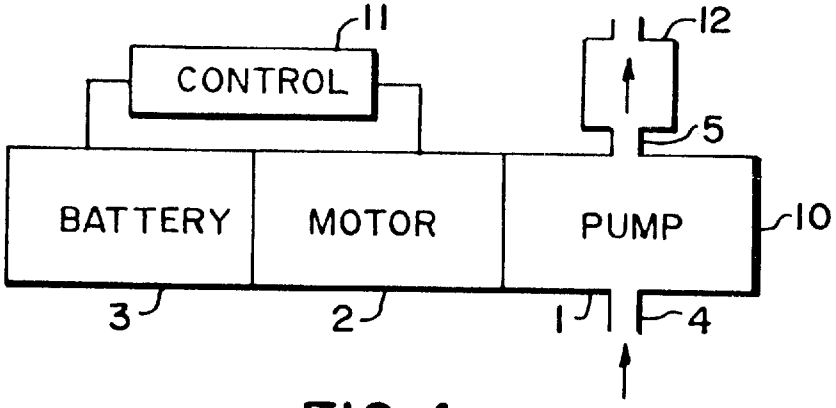
FIG. 4 is a schematic diagram of the operative elements of the portable water jet appliance of FIG. 1.

The operative elements of the portable water jet appliance according to the present invention are depicted schematically in FIG. 4. As shown in this figure, pump 1 is driven by an electric motor 2 which is supplied with electricity from a battery 3 through a control device (e.g., speed control) 11. The battery 3 can be either a dry cell battery or a rechargeable battery, although a rechargeable battery is preferred.

When the entire appliance 10 is submerged in water and turned on, battery 3 supplies electricity to motor 2 which causes the driveshaft of the motor 2 to rotate. The driveshaft is mechanically connected to the pump 1 so that pump 1 is thereby operated. The inlet 4 then draws water from the surrounding pool of water (not shown) into the pump 1, and discharges it through the outlet 5. Outlet 5 can be joined to a hose (not shown) which is equipped with a nozzle (not shown) at the other end or, preferably, outlet 5 is joined directly to an adjustable nozzle or pulsating device 12 to provide a pulsating water jet.

The entire appliance 10 is small enough and light enough in weight so that it can be held in the hand of a person and moved about under water to direct the discharge of water from the outlet 5, or a nozzle joined to outlet 5, to impinge upon the desired parts of the body.

There are various types of pumps that can be used for the pump 1. Such types include, but are not limited to, centrifugal, turbine and diaphragm pumps. The pumps can be constructed of various materials known to those skilled in the art, such as carbon steel, stainless steel, brass and plastic.

It is important that the pump generate sufficient pressure to provide the person using it with a satisfactory massage or stimulation. Generally, the pressure generated ranges from about 20 inches of water to about 200 inches of water and is adjustable within this range. The flow rate of the water discharged from the outlet of the pump generally ranges from about 5 pounds per minute to about 60 pounds per minute and is adjustable within this range.

Figure 5:
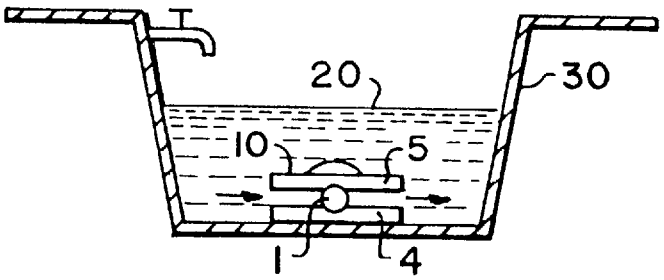
FIG. 5 is a representational diagram of the water jet appliance of FIG. 1 submerged beneath water in a bathtub.

In FIG. 5, the appliance 10 is completely submerged beneath the water 20 in a bathtub 30.

Figure 6:
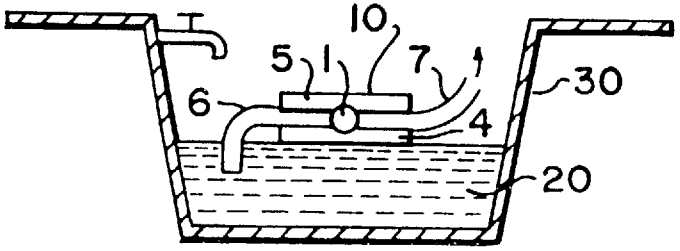
FIG. 6 is a representational diagram of the water jet appliance of FIG. 1 floating on the surface of water in a bathtub and having an intake hose submerged beneath the water level and an outlet hose.

In FIG. 6, the appliance 10 is adapted to float on the surface of the water 20, for example the aid of a styrofoam "base", with the inlet 4 joined to a hose 6, which is disposed beneath the level of water 20. In use, the water 20 is drawn up through the hose 6 to the inlet 4 of the pump 1, whereupon it is discharged from the pump 1 through an outlet 5 to a discharge hose 7.

Figure 7:
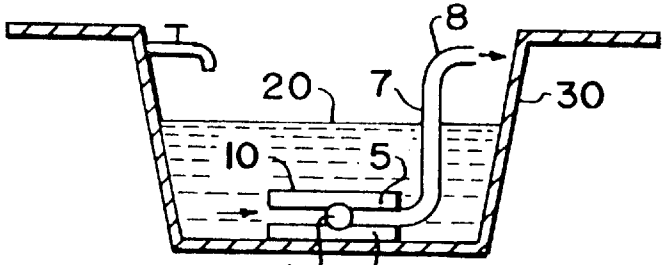
FIG. 7 is a representational diagram of the water jet appliance of FIG. 1 submerged beneath the surface of water in a bathtub and having a discharge hose with a nozzle.

In FIG. 7, the appliance is beneath the water surface, but the discharge hose 7 is above the water surface.

In the practice of this invention, it is contemplated that the portable water jet appliance will be used by a person while taking a bath in a bathtub. It is also contemplated that such a person may prefer to use the appliance in conjunction with discharge hose 7 rather than to hold the entire appliance in hand. It may, under such circumstances, be desirable to temporarily affix the appliance to a single position within the bathtub, which position could be either above or below the water surface.

FIGS. 8–15 illustrate external configurations of the water jet appliance in various alternative embodiments of the invention. Whereas the embodiment shown in FIGS. 1–3 is the principal preferred embodiment, the water jet appliance is by no means limited to the configuration that is shown.

FIGS. 8A and 8B illustrate a water jet appliance 130 in which the "handle" and "head" are joined with a gradual transition to form a unified configuration. The "U" shape of the cross section provides for easy grip. In this case, the appliance is designed to be held in the hand along either its right side, left side or both. The nozzle opening 108 is shown as being located near one end of the appliance. Alternatively, it can be located near the center, midway between both ends.

Similarly, the water inlet (not shown) can be at either end or on the side of the appliance opposite to the nozzle.

FIGS. 9A and 9B illustrate the water jet appliance 140 which is substantially cylindrical in shape. As such, its diameter is sufficiently small to allow a person to grab the cylinder in one hand.

The water nozzle 108 is shown as being near the lower end of the cylinder. Alternatively, it may be positioned substantially midway between the two ends. Similarly, the water inlet may be at either end of the cylinder or along a cylindrical surface either adjacent or opposite to the nozzle 108.

FIG. 10 illustrates a water jet appliance 150 having two U-shaped handles 152 rigidly attached to the body or "head" of the device. The water nozzle 108 is shown on one side of the head 152 although it may also be located at some other position, such as at the bottom. The water inlet (not shown) is preferably arranged on the opposite side of the head to the water nozzle 108.

Figure 11:
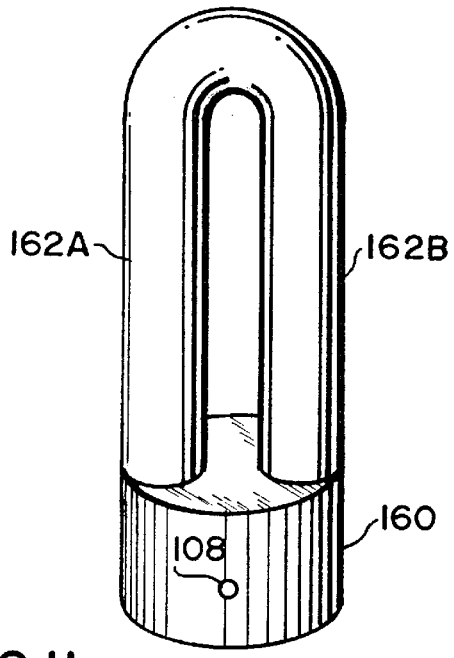
FIG. 11 is a perspective view of one side of a portable water jet appliance according to a fifth preferred embodiment of the invention.

FIG. 11 show s a water jet appliance 16 0 having two parallel handles 162 and 162*b* rigidly attached to the body or "head" of the device and joined together at the top. As in the case of the embodiment of FIG. 10, the water nozzle 108 is shown on one side of the head 160 although it may also be located at some other position, such as the bottom. The water inlet (not shown) is preferably arranged on the head on the side opposite to the in let. In this configuration, one handle is for holding with the left hand and the other is for the right, so that the appliance may be held by one or the other hand or by both hands, as desired.

Figure 12:
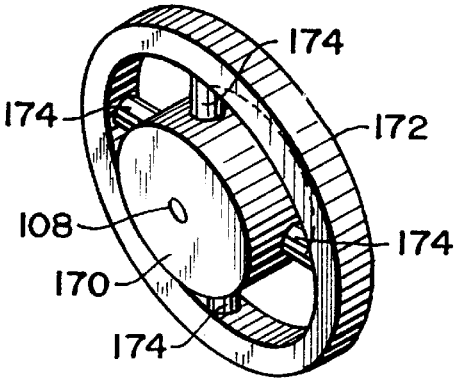
FIG. 12 is a perspective view of one side of a portable water jet appliance according to a sixth preferred embodiment of the invention.

FIG. 12 shows a water jet appliance having a donut-shaped handle 172 attached to a head 170 by spokes 174. The nozzle 108 is arranged on one side of the head 170 and the water inlet (not shown) is arranged on the opposite side.

Figure 13A:
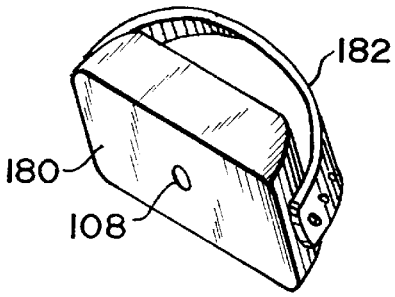
FIG. 13A is a perspective view of one side of a portable water jet appliance according to a seventh preferred embodiment of the invention.
Figure 13B:
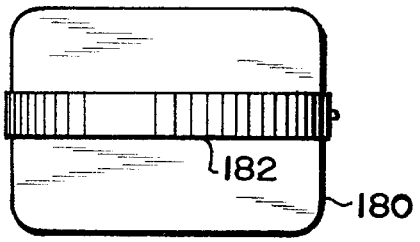
FIG. 13B is a top view of the water jet appliance of FIG. 13A.

FIGS. 13A and 13B illustrate an appliance configuration having a strap 182, which may be flexible and/or adjustable, arranged on a "soap bar" shaped head 180. The nozzle 108 is shown as being located at the bottom of the head 180; however it could also be located on one side. The water inlet is preferably located on the opposite side to the nozzle 108.

The appliance can be held in the hand either by the strap or by the body itself.

Figure 14:
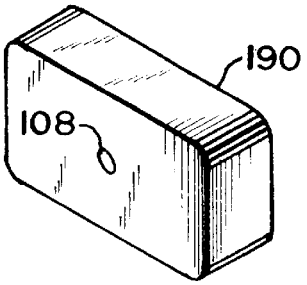
FIG. 14 is a perspective view of one side of a portable water jet appliance according to an eighth preferred embodiment of the invention.
Figure 15:
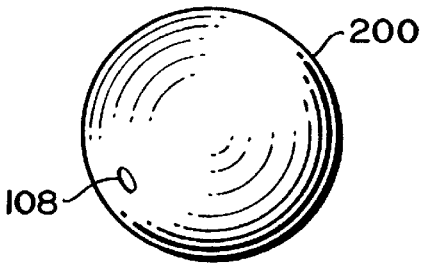
FIG. 15 is a perspective view of one side of a portable water jet appliance according to a ninth preferred embodiment of the invention.

FIGS. 14 and 15 illustrate two further configurations of a water jet appliance which have no handle. In FIG. 14, the appliance 190 is a "soap bar" shape; in FIG. 15, the appliance 200 has a spherical shape. In both cases, the water nozzle 108 is on one side and the water inlet (not shown) is on the opposite or an adjacent side.

Figure 16:
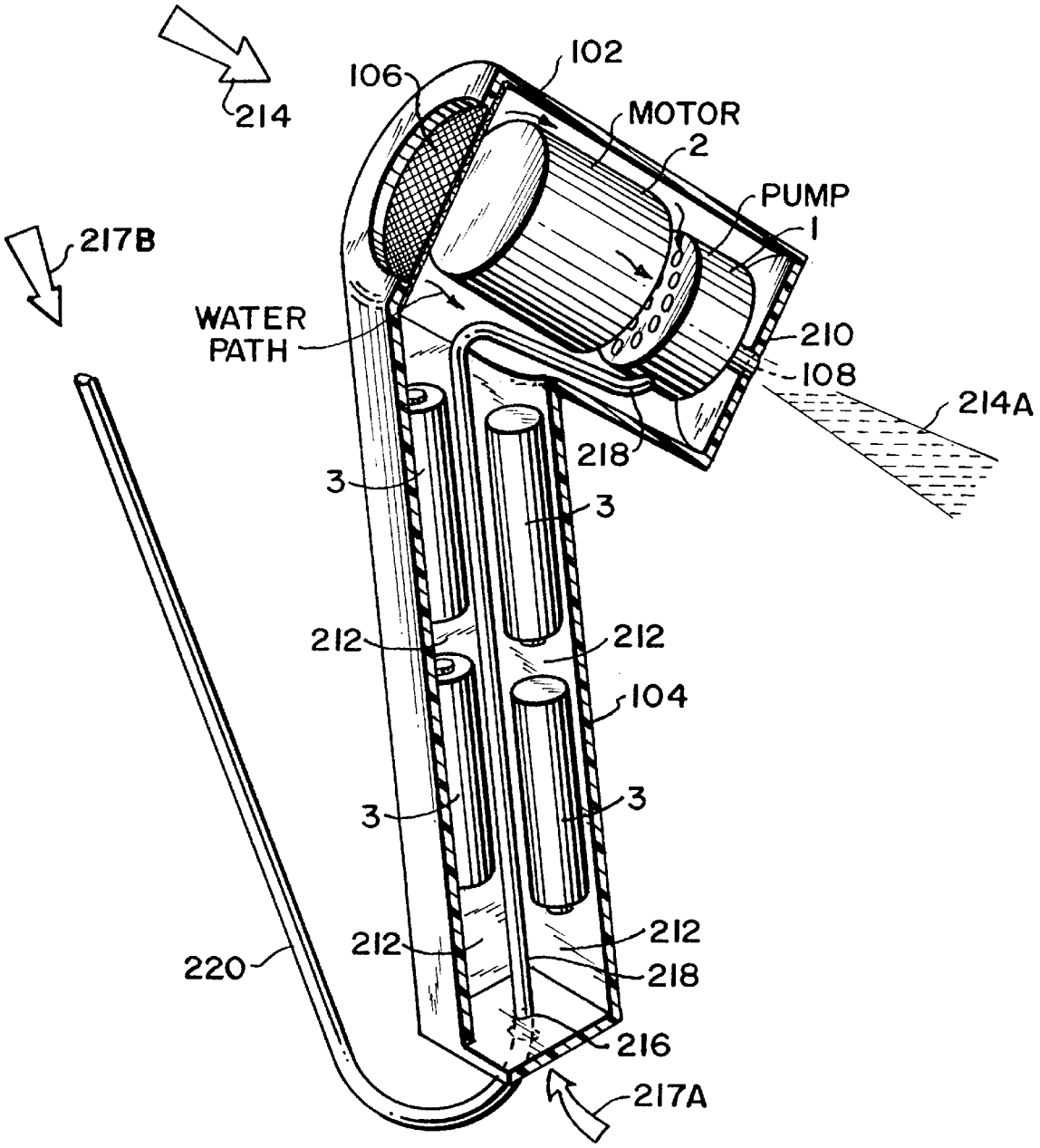
FIG. 16 is a representational diagram of a water jet appliance which incorporates certain features according to the invention.

FIG. 16 is a representational and cut-away view of the water jet appliance of FIGS. 1–3 which incorporates certain advantageous features according to the invention.

As is there shown, the handle 104 of the appliance contains four batteries 3, as well as a significant amount of open space 212 containing air. This air, which is entrapped in the sealed housing, adds buoyancy to the appliance when submersed in the water, for ease of use.

Passing through the handle, from an opening 216 at the end of the handle, is an air tube 218 which leads to the pump 1. When the handle is held such that the opening 216 is above the water, this tube permits air 217*a* to enter the pump 1 to produce an aerated water stream for ejection from the nozzle 108. Alternatively, a flexible tube 220 may be connected to a nipple at the end of the tube 218 to provide a remote inlet 217*b* for air.

As has been described above, water 214 is drawn in by the pump 1 through the inlet port 106. Preferably, this inlet port includes a screen and/or filter to inhibit the entry of contaminants.

Finally, the appliance also includes a heating coil 210 in the path of the water stream to slightly heat the water 214*a* which is ejected through the nozzle 108. This additional heat counteracts the cooling effect of moving water and makes the water jet more comfortable for the user.

FIGS. 17A, 17B, 17C and 17D all illustrate a water jet appliance having a spherical "head" 222 and a tubular "handle" 224. In FIGS. 17A and 17B, the battery, motor and pump are located in the head 222. In FIG. 17A, the inlet port is located in the head and the outlet port at the end of the handle; in FIG. 17B, the inlet port is located at the end of the handle and the outlet port is in the head.

It will be recalled that in the embodiment of FIG. 16, the battery is located in the handle whereas the motor and pump are located in the head of the appliance. In FIG. 17C, the motor is located in the handle while the battery and pump are arranged in the head. Similarly, in FIG. 17D, the pump is arranged in the handle whereas the battery and motor are arranged in the head. It will therefore be understood that the handle of the water jet appliance may hold any one of the main elements: battery, motor and pump.

There has thus been shown and described a novel water jet appliance which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Hand-held, self-contained, self-powered, submersible, portable water jet apparatus comprising, in combination:

(a) an electric battery;

(b) an electric motor, electrically connected to and powered by said battery;

(c) a water pump mechanically connected to and powered by said motor and having an inlet port adapted to draw in surrounding water and an outlet port; said battery, motor and pump being of such capacity as to eject a water stream from said outlet port sufficient for body massage;

(d) a completely submersible housing containing and completely enclosing said battery, motor and pump, said housing having openings for said inlet port and outlet port and, with its contents, having an external physical size and shape as well as a weight that enable said apparatus to be conveniently hand-held when in use and manipulated and transported by a person; and (e) means for heating the water which forms the water stream ejected from the outlet port;

wherein during use the inlet port of the apparatus may be completely submerged and the outlet port may be directed toward the user's body;

whereby the apparatus may be completely submerged in water and held in the hand to direct a heated water stream on any desired part of the body.

2. The apparatus of claim 1, wherein said battery is a rechargeable battery.

3. The apparatus of claim 1, further comprising means for pulsating the water stream.

4. The apparatus of claim 1, further comprising means for adjusting the water pressure and flow at said outlet port.

5. The apparatus of claim 1, further comprising means for adjusting the spread of water emerging from said outlet port.

6. The apparatus of claim 1, wherein said housing includes empty space containing entrapped air, for lending buoyancy to the apparatus when it is submerged.

7. The apparatus of claim 1, further comprising air inlet means providing a source of air to the water pump, whereby the water pump produces an aerated water stream.

8. The apparatus of claim 7, wherein said housing includes a handle, and wherein said air inlet means is located in said handle.

9. The apparatus of claim 1 wherein said housing comprises a handle which contains all or a part of one or more of said battery, motor, pump, inlet port, and outlet port, the remaining portion of said housing containing the remainder of said battery, motor, pump, inlet port, and outlet port.

10. The apparatus of claim 1 wherein said housing comprises an elongate handle portion extending outward in a direction away from the remainder of the housing.

11. The apparatus of claim 1 further comprising a handle formed as a rigid part of said housing.

12. Hand-held, self-contained, self-powered, submersible, portable water jet apparatus comprising, in combination:

(a) an electric battery;

(b) an electric motor, electrically connected to and powered by said battery;

(c) a water pump mechanically connected to and powered by said motor and having an inlet adapted to draw in surrounding water and an outlet; said battery, motor and pump being of such capacity as to eject a water stream from said outlet sufficient for body massage; and (d) a completely submersible housing containing and completely enclosing said battery, motor and pump, said housing having openings for said inlet and outlet and, with its contents, having an external physical size and shape as well as a weight that enable said apparatus to be conveniently hand-held when in use and manipulated and transported by a person, said housing having a handle having with a shape which permits said handle to be conveniently gripped and held by at least one hand of a user so that said housing may be oriented in any desired manner;

said handle containing all or a part of one or more of said battery, motor, pump, inlet and outlet, the remaining portion of said housing containing the remainder of said battery, motor, pump, inlet and outlet;

wherein during use the inlet of the apparatus may be completely submerged and the outlet may be directed toward the user's body;

whereby the apparatus may be completely submerged in water and held in the hand to direct a water stream on any desired part of the body.

13. The apparatus defined in claim 12, wherein said handle is formed as a rigid part of said housing.

14. The apparatus of claim 12, wherein said battery is a rechargeable battery.

15. The apparatus of claim 12, further comprising means for pulsating the water stream.

16. The apparatus of claim 12, further comprising means for adjusting the water pressure and flow at said outlet port.

17. The apparatus of claim 12, further comprising means for adjusting the spread of water emerging from said outlet port.

18. The apparatus of claim 12, wherein said housing includes empty space containing entrapped air, for lending buoyancy to the apparatus when it is submerged.

19. The apparatus of claim 12, further comprising means for heating the water which forms the water stream ejected from said outlet port.

20. The apparatus of claim 12, further comprising air inlet means providing a source of air to the water pump, whereby the water pump produces an aerated water stream.

21. The apparatus defined in claim 20, wherein said air inlet means is located in said handle.

22. The apparatus of claim 12 wherein said handle extends outward in a direction away from the remainder of the housing.

23. Hand-held, self-contained, self-powered, submersible, portable water jet apparatus comprising, in combination:

(a) an electric battery;

(b) an electric motor, electrically connected to and powered by said battery;

(c) a water pump mechanically connected to and powered by said motor and having an inlet port adapted to draw in surrounding water and an outlet port; said battery, motor and pump being of such capacity as to eject a water stream from said outlet port sufficient for body massage; and (d) a completely submersible housing containing and completely enclosing said battery, motor and pump, said housing having openings for said inlet port and outlet port and, with its contents, having an external physical size and shape as well as a weight that enable said apparatus to be conveniently hand-held when in use and manipulated and transported by a person, said housing further having a handle portion extending outward in a direction away from the remainder of housing, said handle portion having a shape which permits said handle portion to be conveniently gripped and held by at least one hand of a user so that said housing may be oriented in any desired manner;

wherein during use the inlet port of the apparatus may be completely submerged and the outlet port may be directed toward the user's body;

whereby the apparatus may be completely submerged in water and held in the hand to direct a water stream on any desired part of the body.

24. The apparatus defined in claim 23, wherein said handle is formed as a rigid part of said housing.

25. The apparatus of claim 23, wherein said battery is a rechargeable battery.

26. The apparatus of claim 23, further comprising means for pulsating the water stream.

27. The apparatus of claim 23, further comprising means for adjusting the water pressure and flow at said outlet port.

28. The apparatus of claim 23, further comprising means for adjusting the spread of water emerging from said outlet port.

29. The apparatus of claim 23, wherein said housing includes empty space containing entrapped air, for lending buoyancy to the apparatus when it is submerged.

30. The apparatus of claim 23, further comprising means for heating the water which forms the water stream ejected from said outlet port.

31. The apparatus of claim 23, further comprising air inlet means providing a source of air to the water pump, whereby the water pump produces an aerated water stream.

32. The apparatus of claim 31, wherein said air inlet means is located in said handle portion.

33. The apparatus of claim 23, wherein said handle portion contains all or a part of one or more of said battery, motor, pump, inlet port, and outlet port, the remaining portion of said housing containing the remainder of said battery, motor, pump, inlet port and outlet port.

34. Hand-held, self-contained, self-powered, submersible, portable water jet apparatus comprising, in combination:

(a) an electric battery;

(b) an electric motor, electrically connected to and powered by said battery;

(c) a water pump mechanically connected to and powered by said motor and having an inlet port adapted to draw in surrounding water and an outlet port; said battery, motor and pump being of such capacity as to eject a water stream from said outlet port sufficient for body massage;

(d) a completely submersible housing containing and completely enclosing said battery, motor and pump, said housing having openings for said inlet port and outlet port and, with its contents, having an external physical size and shape as well as a weight that enable said apparatus to be conveniently hand-held when in use and manipulated and transported by a person; and (e) an air inlet means providing a source of air to the water pump, whereby the water pump produces an aerated water stream;

wherein during use the inlet port of the apparatus may be completely submerged and the outlet port may be directed toward the user's body;

whereby the apparatus may be completely submerged in water and held in the hand to direct a water stream on any desired part of the body.

35. The apparatus of claim 34, wherein said battery is a rechargeable battery.

36. The apparatus of claim 34, further comprising means for pulsating the water stream.

37. The apparatus of claim 34, further comprising means for adjusting the water pressure and flow at said outlet port.

38. The apparatus of claim 34, further comprising means for adjusting the spread of water emerging from said outlet port.

39. The apparatus of claim 34, wherein said housing includes empty space containing entrapped air, for lending buoyancy to the apparatus when it is submerged.

40. The apparatus of claim 34, further comprising means for heating the water which forms the water stream ejected from said outlet port.

41. The apparatus of claim 34, wherein said housing includes a handle, and wherein said air inlet means is located in said handle.

42. The apparatus of claim 34, further comprising a handle formed as a rigid part of said housing.

43. The apparatus of claim 34, wherein said housing comprises a handle which contains all or a part of one or more of said battery, motor, pump, inlet port, and outlet port, the remaining portion of said housing containing the remainder of said battery, motor, pump, inlet port, and outlet port.

44. The apparatus of claim 34 wherein said housing comprises an elongate handle portion extending outward in a direction away from the remainder of the housing.

45. Hand-held, self-contained, self-powered, submersible, portable water jet apparatus comprising, in combination:

(a) an electric battery;

(b) an electric motor, electrically connected to and powered by said battery;

(c) a water pump mechanically connected to and powered by said motor and having an inlet adapted to draw in surrounding water and an outlet; said battery, motor and pump being of such capacity as to eject a water stream from said outlet sufficient for body massage; and (d) a completely submersible housing containing and completely enclosing said battery, motor and pump, said housing having openings for said inlet and outlet and, with its contents, having an external physical size and shape as well as a weight that enable said apparatus to be conveniently hand-held when in use and manipulated and transported by a person, said housing having a handle with a shape which permits said handle to be conveniently gripped and held by at least one hand of a user so that said housing may be oriented in any desired manner;

said handle being formed as a rigid part of said housing;

wherein during use the inlet of the apparatus may be completely submerged and the outlet may be directed toward the user's body;

whereby the apparatus may be completely submerged in water and held in the hand to direct a water stream on any desired part of the body.

46. The apparatus of claim 45, wherein said battery is a rechargeable battery.

47. The apparatus of claim 45, further comprising means for pulsating the water stream.

48. The apparatus of claim 45, further comprising means for adjusting the water pressure and flow at said outlet.

49. The apparatus of claim 45, further comprising means for adjusting the spread of water emerging from said outlet.

50. The apparatus of claim 45, wherein said housing includes empty space containing entrapped air, for lending buoyancy to the apparatus when it is submerged.

51. The apparatus of claim 45, further comprising means for heating the water which forms the water stream ejected from said outlet.

52. The apparatus of claim 45, further comprising air inlet means providing a source of air to the water pump, whereby the water pump produces an aerated water stream.

53. The apparatus defined in claim 52, wherein said air inlet means is located in said handle.

54. The apparatus of claim 45, wherein said handle extends outward in a direction away from the remainder of the housing.

55. The apparatus of claim 45, wherein said handle contains all or part of one or more of said battery, motor, pump, inlet and outlet and the remaining portion of said housing contains the remainder of said battery, motor, pump, inlet and outlet.

* * * * *